United States Patent [19]

Ito et al.

[11] Patent Number: 4,666,527

[45] Date of Patent: May 19, 1987

[54] CONTINUOUS CRYSTALLIZATION OF FRUCTOSE ANHYDRIDE

[75] Inventors: Yoshikuni Ito; Jinshu Kanamoto; Seiji Murayama; Shinji Suzuki, all of Aichi, Japan

[73] Assignee: Kato Kagaku Co., Ltd., Aichi, Japan

[21] Appl. No.: 669,039

[22] Filed: Nov. 6, 1984

[30] Foreign Application Priority Data

Nov. 29, 1983 [JP] Japan ..... 58-223170

[51] Int. Cl.[4] ..... C13F 1/02

[52] U.S. Cl. ..... 127/60; 127/16; 127/30

[58] Field of Search ..... 127/15, 16, 58, 60, 127/30

[56] References Cited

U.S. PATENT DOCUMENTS 3,607,392 9/1971 Lauer et al. ..... 127/30 X
3,928,062 12/1975 Yamauchi ..... 127/60
4,056,364 11/1977 Dmitrovsky et al. ..... 127/16 X

FOREIGN PATENT DOCUMENTS 865102 1/1953 Fed. Rep. of Germany ..... 127/16

*Primary Examiner*—Richard V. Fisher
*Assistant Examiner*—W. Gary Jones
*Attorney, Agent, or Firm*—Browdy and Neimark

[57] ABSTRACT

The present invention relates to a process for continuously crystallizing fructose anhydride using a seed crystallization tank and a crystallization tank separated from each other, comprising feeding an aqueous fructose solution containing at least 90% of fructose and containing at least 87 W/W % of solid and an aqueous solution containing a great deal of crystals in an amount of 0.5 to 5 times that of said fructose solution into a seed crystallization tank equipped with a high speed agitator, mixing the mixture at 40° to 50° C. at a high speed, introducing the obtained mixture into a crystallization tank and gradually cooling the mixture under condition under which new crystals do not form spontaneously to thereby grow the crystals. The present invention can realize the crystallization at a low temperature of 40° to 50° C. or below and prevents the decomposition and the polymerization of fructose which often occur above 50° C. by mixing an aqueous fructose solution and a great deal of crystals at a high speed, whereby large and uniform crystals of fructose anhydride can be obtained in an enhanced yield.

9 Claims, 1 Drawing Figure

CONTINUOUS CRYSTALLIZATION OF FRUCTOSE ANHYDRIDE

BACKGROUND OF THE INVENTION

1. Field of the Invention

The present invention relates to a process for crystallizing fructose and a device therefor. More particularly, it relates to a process for continuously recovering large and uniform crystals of fructose in a good yield from an aqueous solution thereof and for facilitating separation of syrup from the crystal.

2. Description of the Prior art

Generally speaking, crystallization of fructose must be carried out from an aqueous fructose solution of a high concentration because fructose has a high solubility in water. However, it is quite difficult to separate syrup from crystalline massecuite because of the high viscosity of the aqueous solution caused by its high concentration. Further, fructose is highly soluble, as is apparent from its solubility of 87 W/W % at 50° C., is liable to decompose at a high temperature or due to changes in pH, and is liable to polymerize. Consequently, more care must be taken in crystallizing fructose anhydride than in crystallizing sucrose or glucose.

Evaporation in a concentration device has been conventionally carried out at a low temperature under high vacuum because of the unstability of fructose. However, in batch concentration devices, a long concentration time and a high concentration temperature are needed owing to a large liquid depth leading to boiling point elevation, so that the fructose tends to decompose to bring about coloration or polymerization.

In recent years, accordingly, a continuous concentration system begins to be employed that needs only a short concentration time and a low concentration temperature in concentrating aqueous fructose solutions and aqueous fructose-glucose solutions. The employment of such a continuous concentration system for concentrating sugar solution has led inevitably to the demand for a continuous crystallization device.

Most of conventional cooling crystallization equipments generally used are of an internal cooling batch system in which cooling water is introduced into a horizontal jacket or an agitating part or ribbon mixer thereof. Conventional continuous systems are a mere combination of a number of the above batch systems. That is to say, the batch cooling crystallization equipment includes the steps of feeding raw material, crystallizing sugar and separating crystals, and needs at least three crystallizing devices. Since each of the crystallizing devices must be accompanied by attachment devices such as automatic instruments, the total cost of the equipment is markedly great.

The batch crystallizing operation is performed by adding 1 to 5% of seed crystals to at least 90 W/W % of concentrated fructure solution at 60° to 65° C. and gradually cooling the solution to grow the crystal particles, while the degree of supersaturation is controlled to a low value to inhibit the spontaneous generation of crystals. This operation inevitably needs a long crystallization time, and also needs a long time at the high temperature stage at the initial stage, so that denaturation such as coloration or polymerization due to the decomposition of the sugar may occur.

We, the inventors of the present invention have studied to overcome the above-mentioned drawbacks of the prior art and to realize the continuous crystallization of fructose anhydride from the aqueous solution thereof. As the result, we have succeeded in the development of a continuous process of the present invention for obtaining large and uniform fructose anhydride crystals with syrup separability in a good yield without any denaturation of sugars. According to a known process for crystallizing fructose anhydride, an aqueous solution containing about 95% of fructose is concentrated up to a concentration of 92 to 94 W/W % in solid content and placed in an auxiliary crystallizer, and the temperature of the solution is lowered carefully from a temperature of 60° to 65° C. to a temperature of 30° to 35° C. at a rate of 1° C. per four hours after addition of 1 to 5% of powdered fructose as seed crystals. The yield is 40 to 50%. (see Shinji Tanaka, SWEETNING AGENT, published by Korin Shoin)

However, it was found from the analysis of products that the above process results in a weight loss of 2 to 10% of fructose and a marked increase in the amount of polymerized fructose owing to the decomposition and polymerization of fructose caused by holding the solution at a high temperature of 60° to 65° C. for a long time. There has been also proposed a process wherein the pH of the solution is controlled to within 4.5 to 5.5, particularly 5.0, by the use of sodium carbonate or the like to improve the yield because the formation of the polymerized fructose depends on the Ph of the solution (see Japanese Patent Publication No. 105842/1975).

In recent years, a very high quality is demanded also for the high-fructose solution as the amount of the fructose-glucose solution used for soft drinks increases. Therefore, the high-fructose solution is prepared by the use of purifying steps of decoloring with activated charcoal, desalting with ion exchange resins and the like. As the result, salts are scarcely contained in the fructose solution, and the solution has a quite small buffering action. For example, when a solution having a solid content of 91.3 W/W %, a pH of 4.9 and a fructose content of 96.8% was held at 60° C. for 10 hours, the pH of the solution decreased to 3.8 and the fructose content decreased to 93.6%, i.e., a loss of 3.2%. When the same solution as mentioned above was held at 45° C. for 10 hours, the pH decreased to 4.6 and the fructose content decreased to 96.7%.

As these examples show, if the decomposition and polymerization are controlled by regulating the pH of the solution, the weight loss of fructose of several % is inevitable because of the formation of acidic substances by the decomposition of fructose.

DESCRIPTION OF THE INVENTION

According to the present invention, however, it is possible to perform the crystallizing operation at a low temperature of 45° C. Accordingly, in the practice of the invention, the weight loss of fructose can be reduced to 7% or less when the pH is within the range of 3.5 to 6.0, and it can be reduced to 0.5% or less when the pH is within the range of 4.0 to 5.5 as standardized for fructose and glucose in Japanese Agricultural Standards, and therefore the troublesome operation of pH regulation can be omitted. In addition, because of the remarkable decrease in the weight loss of fructose, the concentration at which the crystallization of a solution having a solid content of 92 to 94 W/W % is carried out can be set within the range of 89 to 91%, which is lower by 2 to 3% than that in the prior art. Therefore, the syrup separability of crystalline massecuite has been markedly improved because of the decrease in the viscosity of the solution.

Figure 1:
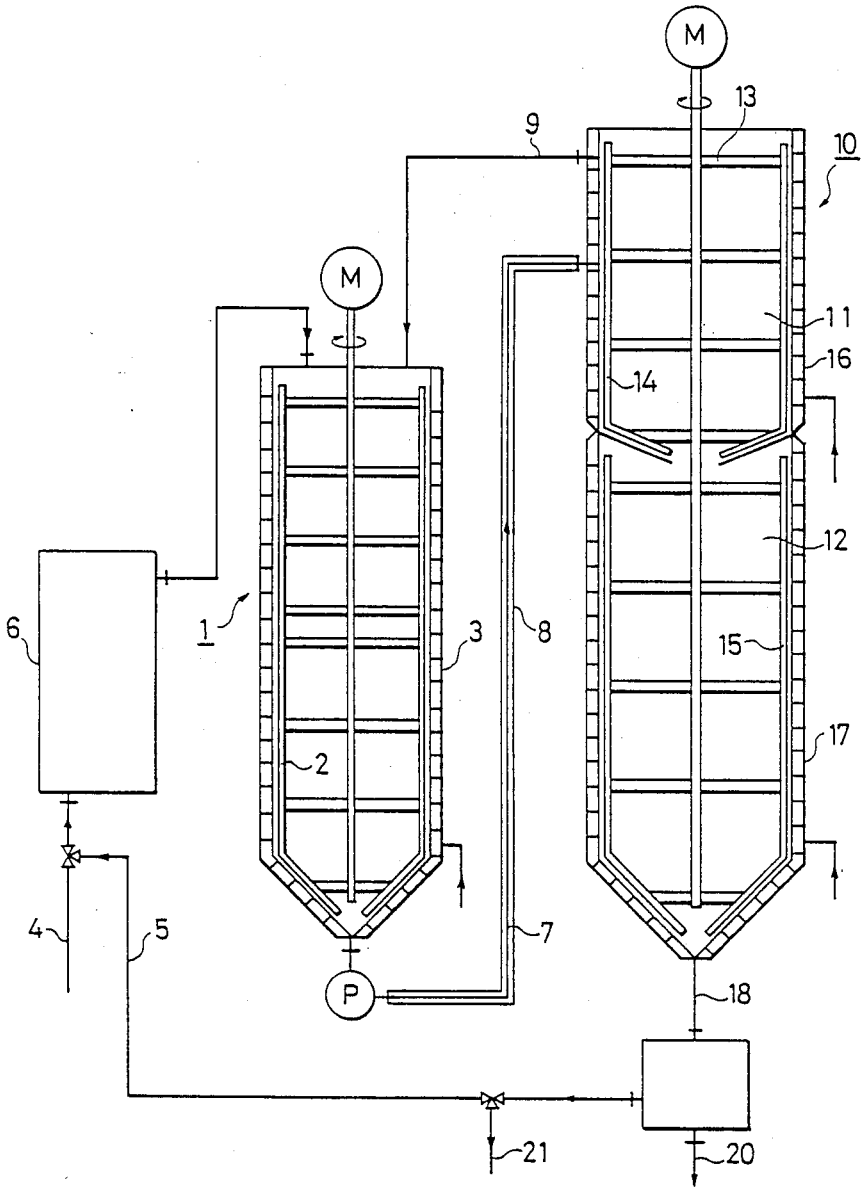
FIG. 1 shows equipment for continuously crystallizing fructose anhydride according to the present invention.

The present invention relates to a process for continuously crystallizing fructose anhydride which comprises feeding an aqueous fructose solution containing at least 90% of fructose and containing at least 87 W/W % of solid and an aqueous solution containing a great deal of crystals in an amount of 0.5 to 5 times that of said fructose solution into a seed crystallization tank equipped with a high speed agitator, mixing the mixture at 40° to 50° C. at a high speed, introducing the obtained mixture into a crystallization tank and gradually cooling the mixture under conditions under which new crystals do not form spontaneously to thereby grow the crystals.

The present invention also relates to a process for continuously crystallizing fructose anhydride which comprises feeding a sugar solution and a great deal of crystals into a seed crystallization tank equipped with a high speed agitator, continuously mixing the mixture for seed crystallization in said tank, heating the mixture to control the amount of the crystal particles by dissolving fine crystals of the crystals grown and those formed spontaneously in said seed crystallization tank, continuously feeding the mixture into a crystallization tank equipped with a low speed agitator that prevents the crystals from being damaged to thereby form crystals.

In the present invention, the seed crystallization tank and the crystallization tank are separated such that the mixing of seed crystals and crystallization can be carried out independently at different temperatures and under different agitating conditions.

In the crystallization step of the fructose anhydride, an aqueous fructose solution containing at least 90 W/W %, preferably at least 95 W/W % of fructose is concentrated to a solution with a solid concentration of 87 to 97 W/W %, and an aqueous sugar solution containing a great deal of crystals overflown from the crystallization tank is fed into the seed crystallization tank and mixed with the concentrated solution in a ratio of 0.5 to 5, preferably 1 to 2. Into the lower part of an external jacket of the seed crystallization tank is fed cooling water to produce a temperature gradient in such a way that the temperature of the upper part of the solution is 40° to 50° C. while that of the lower part of the solution is 30° to 40° C. Said mixture moves toward the lower part of the seed crystallization tank in an amount corresponding to that of the mixture which is withdrawn from the lower part and then is cooled, whereby the crystals grow. Since the cooling rate in the seed crystallization tank is great for the purpose of shortening the crystallization time, fine crystals form spontaneously.

When feeding the sugar solution containing crystals continuously from the seed crystallization tank to the crystallization tank, it is heated up to 35° to 45° C. to dissolve the fine crystals and to control the number of the crystals before being fed to the crystallization tank.

Cooling water is introduced into the lower part of the external jacket of the crystallization tank so that the temperature of the solution in the upper part of the crystallization tank is 35° to 45° C. and that in the lower part thereof is 25° to 35° C., and is discharged depending on the amount of the massecuite discharged in the lower part.

The crystalline massecuite is separated by centrifugation as in conventional processes, and the separated syrup can be partially fed into the seed crystallization tank or the concentration device and then continuously added to the starting aqueous fructose solution to improve the yield.

Preferably, in the present invention, the addition of seed crystals is carried out by continuously adding 1 to 5% of powdered crystals in the seed crystallization tank only when the operation is initiated and feeding the overflow from the upper part of the crystallization tank into the seed crystallization tank during the stationary operation. Mixing with the sugar solution containing a great deal of crystals at a high speed makes it possible to lower the degree of super saturation of the sugar solution and the temperature of the solution in the seed crystallization tank. As the result, the crystallization time can be shortened because of the increase in crystallization rate and the denaturation of the sugar solution can be effectively prevented.

The seed crystallization tank is in the form of a vertical cylinder with a ratio of diameter to height of 1:2 to 1:10, has a variable-speed agitator of 10 to 30 r.p.m. provided inside for mixing the sugar solution with the seed crystals at a high speed, and has a spiral jacket provided outside, into the lower part of which cooling water is introduced and from the upper part of which it is discharged. The temperature of the solution is controlled so as to produce a temperature gradient in the tank such that the temperature is lower in the lower part of the tank and higher in the upper part thereof.

The crystallization tank is in the form of a vertical cylinder, has an agitator provided inside that can agitate the solution slowly so as to prevent the crystals from being damaged, and has a jacket provided outside so as to control the temperature of the sugar solution. Preferably, the ratio of diameter to height of the crystallization tank is 1:2 to 1:10, a number of chambers for crystallization are constructed, and the bottom is inclined by 15° to 60° to facilitate the discharge of the crystalline massecuite. The crystals fed into the crystallization tank move from the lower part of each chamber to the lower chamber in an amount depending on the amount of discharged massecuite. The crystallization tank has a spiral jacket provided outside, into the lower part of which cooling water is introduced and from the upper part of which it is discharged.

The temperature of the solution in the crystallization tank is preferably controlled by the cooling system to produce a temperature gradient such that the temperature is lower in the lower part of the tank and is higher in the upper part thereof. The crystallization section may consist of either a single chamber or a plurality of chambers. The structure having a number of chambers facilitates the control of the temperature but also facilitates the formation of mimetic crystals. Therefore, the structure having two chambers is most preferred.

The sugar solution containing crystals moves downward as a laminar flow without giving rise to turbulent flow because it has a temperature gradient such that the temperature is higher in the upper part and lower in the lower part.

Preferably, the agitator in the crystallization tank can bring about its agitating effect horizontally but not vertically. In order to prevent the turbulent flow and the destruction of the crystals, the agitation can be preferably made at a low speed variable within the range of 0 to 5 r.p.m.

In FIG. 1 which illustrates one example of equipment for continuously crystallizing fructose anhydride according to the present invention, reference numeral 1 refers to a seed crystallization tank, 2 to an agitating element and 3 to a jacket, which is constructed so that cooling water can be passed from the lower part to cool the seed crystallization tank suitably. An aqueous sugar solution is fed through a transport pipe 4 and a separated syrup transport pipe 5 into a concentration device 6, where the solution is concentrated to a concentration of 87 to 92%. The concentrated sugar solution is continuously transported to the seed crystallization tank 1, and seed crystals which overflow a crystallization tank 10 through an upper overflow-pipe 9 are also fed into the seed crystallization tank 1, and then both of them are continuously mixed. The mixture is continuously pumped into the crystallization tank 10. A pipe 7 serves to feed warm water into an external warm water jacket 8 and the water warms and dissolves fine crystals. The crystallization tank 10 is composed of an upper crystallization chamber 11 and a lower crystallization chamber 12 each of which has an inclined bottom. 13 is an agitator equipped with agitating elements 14 and 15. Each agitating element turns along the side wall and the bottom of the crystallization tank so as to slowly agitate the mixture, thereby preventing the crystals of sugar from adhering to the wall or the bottom.

16 and 17 are jackets which are constructed so that cooling water can be introduced from its lower part to control the temperature suitably.

The crystalline massecuite is continuously withdrawn through a pipe 18 and transported to a centrifuge 19 and centrifuged. The crystals are discharged through a pipe 20.

The separated syrup is transported through of pipes 5 and 21.

range of 10 to 30 r.p.m. The agitator was driven at an agitation rate of 15 r.p.m. in this example.

The crystallization tank had an internal diameter of 70 cm, a height of 240 cm, an internal volume of the upper crystallization chamber of 270 l and an internal volume of the lower crystallization chamber of 500 l and was provided with an agitator capable of being driven at an agitation rate variable within the range of 0 to 5 r.p.m. The agitator was driven with an agitation rate of 0.5 r.p.m. in this example. For the crystallization of fructose anhydride in this example, an aqueous fructose solution separated from an aqueous glucose fructose solution using a calcium type cation exchange resin.

The above aqueous fructose solution was concentrated to a solid content of 89 to 90 W/W %, and the concentrated solution was continuously sent to the seed crystallization tank. Initially powdered fructose was continuously mixed with the concentrated solution in an amount of 5% of the latter. After the system became stationary, seed crystals overflowing through the upper part of the crystallization tank was continuously mixed with the concentrated solution.

The above process without mixing of separated syrup (which is referred to as "one-pass method") was carried out twice. The same process with mixing of separated syrup (which is referred to as "syrup mixing method") was carried out twice. The conditions, yields, etc. are given in Table 1 for each method. Incidentally, the results of analysis by liquid chromatography were used for fructose. The yield of the crystals was calculated by the following equation after washing the washing water by use of 2% of the massecuite and drying:

$$\text{Yield} = \frac{\text{Weight of crystals}}{\text{Weight of solids in the starting solution} \times \text{fructose content}}$$

TABLE 1

| | One-pass method | One-pass method | Syrup mixing method | Surup mixing method |
|---|---|---|---|---|
| Fructose content in the starting solution W/W | 95~97% | 95~97% | 96~98% | 95~97% |
| Solid content W/W | 89~90% | 88~89% | 89~90% | 89~90% |
| Temp. in the upper part of the seed crystallization tank °C. | 45 | 48 | 45 | 48 |
| Temp. in the lower part of the seed crystallization tank °C. | 35 | 40 | 35 | 40 |
| Rise in temperature °C. | 40 | 45 | 40 | 45 |
| Upper chamber of the crystallization tank °C. | 38→35 | 43→40 | 38→35 | 43→38 |
| Lower chamber of the crystallization tank °C. | 40→30 | 40→30 | 35→25 | 38→25 |
| Overflow from the crystallization tank kg/H | 28 | 14 | 14 | 15 |
| Feed of the starting solution kg/H | 28 | 14 | 8 | 10 |
| Feed of the separated syrup kg/H | | | 6 | 5 |
| Discharge amount of the massecuite kg/H | 28 | 14 | 14 | 15 |
| Crystallization time | 51 | 103 | 103 | 96 |
| Yield of crystals % | 45.6 | 46.2 | 66.2 | 63.6 |
| Purity of fructose % | ≧99.5 | ≧99.5 | ≧99.5 | ≧99.5 |
| Distribution of particle size | | | | |
| 32 mesh or greater | 18.3 | 36.6 | 25.2 | 16.4 |
| 32 to 42 mesh | 43.8 | 49.3 | 42.6 | 42.5 |
| 42 to 48 mesh | 14.7 | 13.3 | 16.3 | 14.8 |
| 48 to 60 mesh | 13.1 | 0.8 | 12.8 | 14.2 |
| 60 mesh or less | 10.1 | 0 | 3.1 | 12.1 |

EXAMPLE

The equipment as shown in FIG. 1 was used.

The seed crystallization tank had an internal diameter of 40 cm, a height of 150 cm and an internal volume of 200 l and was provided with an agitator capable of being driven at an agitation rate variable within the

What is claimed is:

1. A process for continuously crystallizing fructose anhydride which comprises:

providing a cyrstallization tank comprising an upper crystallization chamber maintained at a temperature of 35°–45° C. and a lower crystallization chamber maintained at a temperature lower than said upper crystallization chamber of between 25°–35° C., a connecting passage being provided between said upper and lower crystallization chambers, whereby a first decreasing temperature gradient from said upper to said lower crystallization chambers is maintained;

providing a seed crystallization tank having a high speed agitator;

maintaining an upper portion of said seed crystallization tank at 40°–50° C.;

maintaining a lower portion of said seed crystallization tank at 30°–40° C. so that a second gradient of decreasing temperature between said upper and lower portions of said seed crystallization tank is maintained;

feeding a first aqueous solution containing at least 90% of fructose and containing at least 87 W/W % of solid and a second aqueous solution, containing 25–35 W/W % of crystals, from said upper crystallization chamber in an amount of 50–500% of the first aqueous solution into said upper portion of said seed crystallization tank, at 40°–50° C., with high speed agitation of said seed crystallization tank to obtain mixture;

removing said mixture from said lower portion of said seed crystallization tank, whereby said mixture has been gradually cooled by said second gradient of decreasing temperature;

feeding said removed mixture into said upper crystallization chamber and flowing said removed mixture through said upper crystallization chamber into said connecting passage and then into said lower cyrstallization chamber, whereby said mixture is subjected to said first temperature gradient and said mixture is thereby gradually cooled under conditions such that new crystals do not form spontaneously, to thereby grow said crystals in said lower cyrstallization chamber; and isolating said crystals.

2. A process according to claim 1, wherein said mixture removed from the lower portion of the seed crystallization tank and fed to the upper crystallization chamber is heated to dissolve fine crystals in said removed mixture.

3. A process according to claim 1, wherein a portion of the mixture separated from said grown crystals during said isolation step is continuously mixed with said first aqueous solution.

4. A process according to claim 1 which comprises providing said crystallization tank with a low speed agitator which prevents crystals from being damaged.

5. A process according to claim 1 wherein said seed crystallization tank and said crystallization tank are each in the form of a vertical cylinder with a ratio of diameter to height of 1:2 to 1:10 and provided with a temperture controller for controlling the temperature of the solution by heating or cooling and with a bottom inclined by 15 to 60 degrees to facilitate the discharge of the crystalline massecuite.

6. A process according to claim 1 wherein each of said tanks has a jacket thereabout and cooling of the seed crystallization tank and the crystallization tank is carried out by introducing cooling water into the lower part of each jacket and discharging it from the upper part of each jacket to produce a temperature gradient in such a way that the temperature of the tank is lower in the lower part and higher in the upper part.

7. A process according to claim 1, wherein the entire process is conducted at ambient pressure.

8. The process of claim 1, whereby said mixture removed from said lower portion of said seed cyrstallization tank is fed into said upper crystallization chamber at a point below where said second aqueous solution is removed from said upper crystallization chamber.

9. The process of claim 8, whereby said mixture in said lower portion of said seed crystallization chamber is pumped into said upper crystallization chamber.

* * * * *